US007467511B2

(12) United States Patent
Sczomak et al.

(10) Patent No.: US 7,467,511 B2
(45) Date of Patent: Dec. 23, 2008

(54) EMISSION CONTROL STRATEGY FOR LEAN IDLE

(75) Inventors: David P. Sczomak, Troy, MI (US); David B. Brown, Brighton, MI (US); Stephen K. Fulcher, Clovis, NM (US); Jesse M. Gwidt, Brighton, MI (US); Michael J. Lucido, Northville, MI (US); Christopher R. Graham, Lake Orion, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 412 days.

(21) Appl. No.: 11/134,234

(22) Filed: May 20, 2005

(65) Prior Publication Data

US 2006/0260294 A1 Nov. 23, 2006

(51) Int. Cl.
*F01N 3/00* (2006.01)

(52) U.S. Cl. ..... 60/277

(58) Field of Classification Search ..... 60/277
See application file for complete search history.

(56) References Cited

U.S. PATENT DOCUMENTS

| | | | | |
|---|---|---|---|---|
| 4,760,822 | A * | 8/1988 | Mieno et al. | 123/325 |
| 5,228,286 | A * | 7/1993 | Demura | 60/276 |
| 5,438,826 | A * | 8/1995 | Blischke et al. | 60/276 |
| 5,444,977 | A * | 8/1995 | Kawabata | 60/276 |
| 6,622,479 | B2 * | 9/2003 | Kakuyama et al. | 60/285 |
| 6,701,706 | B2 * | 3/2004 | Bruck et al. | 60/276 |
| 6,812,029 | B2 * | 11/2004 | Ohsuga et al. | 436/37 |
| 6,828,156 | B2 * | 12/2004 | Ohsuga et al. | 436/135 |

* cited by examiner

*Primary Examiner*—Thomas Denion
*Assistant Examiner*—Loren Edwards

(57) ABSTRACT

An engine control system that regulates fuel to an engine after lean idle operation includes a first module that determines a rich mass fuel rate based on a lean operation mass air flow and a stoichiometric air to fuel ratio (AFR) and that calculates a time rich based on the rich mass fuel rate. A second module regulates fuel to the engine during a rich operation period after the lean idle operation to provide the rich mass fuel rate for the time rich.

12 Claims, 4 Drawing Sheets

EMISSION CONTROL STRATEGY FOR LEAN IDLE

FIELD OF THE INVENTION

The present invention relates to internal combustion engines, and more particularly to a post-lean idle emission control.

BACKGROUND OF THE INVENTION

During the combustion process, gasoline is oxidized, and hydrogen (H) and carbon (C) combine with air. Various chemical compounds are formed including carbon dioxide ($CO_2$), water ($H_2O$), carbon monoxide (CO), nitrogen oxides ($NO_x$), unburned hydrocarbons (HC), sulfur oxides ($SO_x$), and other compounds.

Automobile exhaust systems include a three-way catalytic converter that helps oxidize CO, HC and reduce $NO_x$ in the exhaust gas. The catalytic converter includes an oxygen storage capability to provide a buffer for lean to rich air-to-fuel (AFR) deviations. For example, oxygen is stored in the catalytic converter during lean operation (i.e., excess air) and is depleted from the catalytic converter during rich operation (i.e., excess fuel).

During idle, engines may be operated using a lean AFR (i.e., an AFR greater than stoichiometry ($AFR_{STOICH}$)) to improve fuel consumption. More specifically, because a lean AFR is used, less fuel is consumed during idle. However, extended lean operation presents a challenge for exhaust after-treatment. One challenge is that the catalytic converter's NOx conversion efficiency falls off rapidly as the AFR goes lean and the catalyst becomes saturated with oxygen. Lean NOx trapping after-treatment technology has been developed to address this issue.

Another challenge is that excess oxygen is stored in the catalytic converter. More specifically, catalytic converters are formulated to store a targeted mass of oxygen. This enhances catalyst efficiency by acting as a buffer for small rich deviations, during which oxygen is released for oxidation, and lean deviations, during which the excess oxygen is stored. During extended lean operation, the catalytic converter becomes saturated with oxygen. The NOx conversion efficiency is then reduced until some of the excess oxygen is removed. The excess oxygen must be removed prior to returning to stoichiometric operation (i.e., operation using $AFR_{STOICH}$), for proper 3-way (i.e., HC, CO, and NOx) conversion efficiency to resume.

Engine control systems can remove the excess oxygen with a short period of rich operation after lean idle. As a result, excess fuel is consumed. This fuel consumption penalty cancels out some of the benefit of lean idle operation.

SUMMARY OF THE INVENTION

Accordingly, the present invention provides an engine control system that regulates fuel to an engine after lean idle operation. The engine control system includes a first module that determines a rich mass fuel rate based on a lean operation mass air flow and a stoichiometric air to fuel ratio (AFR) and that calculates a time rich based on the rich mass fuel rate. A second module regulates fuel to the engine during a rich operation period after the lean idle operation to provide the rich mass fuel rate for the time rich.

In other features, the first module calculates a mass of oxygen stored during the lean idle operation and determines an oxygen to fuel ratio (OFR) based on the stoichiometric AFR. The time rich is further calculated based on the mass of oxygen stored and the OFR. The first module calculates a product of a % oxygen content of air by mass, the lean operation mass air flow and a lean time and determines the mass of oxygen stored as a minimum of the product and a target mass of oxygen stored. The target mass of oxygen stored is based on a storage factor and a storage capacity of the catalytic converter.

In still other features, the engine control system further includes a third module that corrects the time rich based on an inlet sensor signal and an outlet sensor signal of the catalytic converter. The third module measures an actual response time between the inlet sensor signal and the outlet sensor signal and calculates a correction factor based on the actual response time and a target response time.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
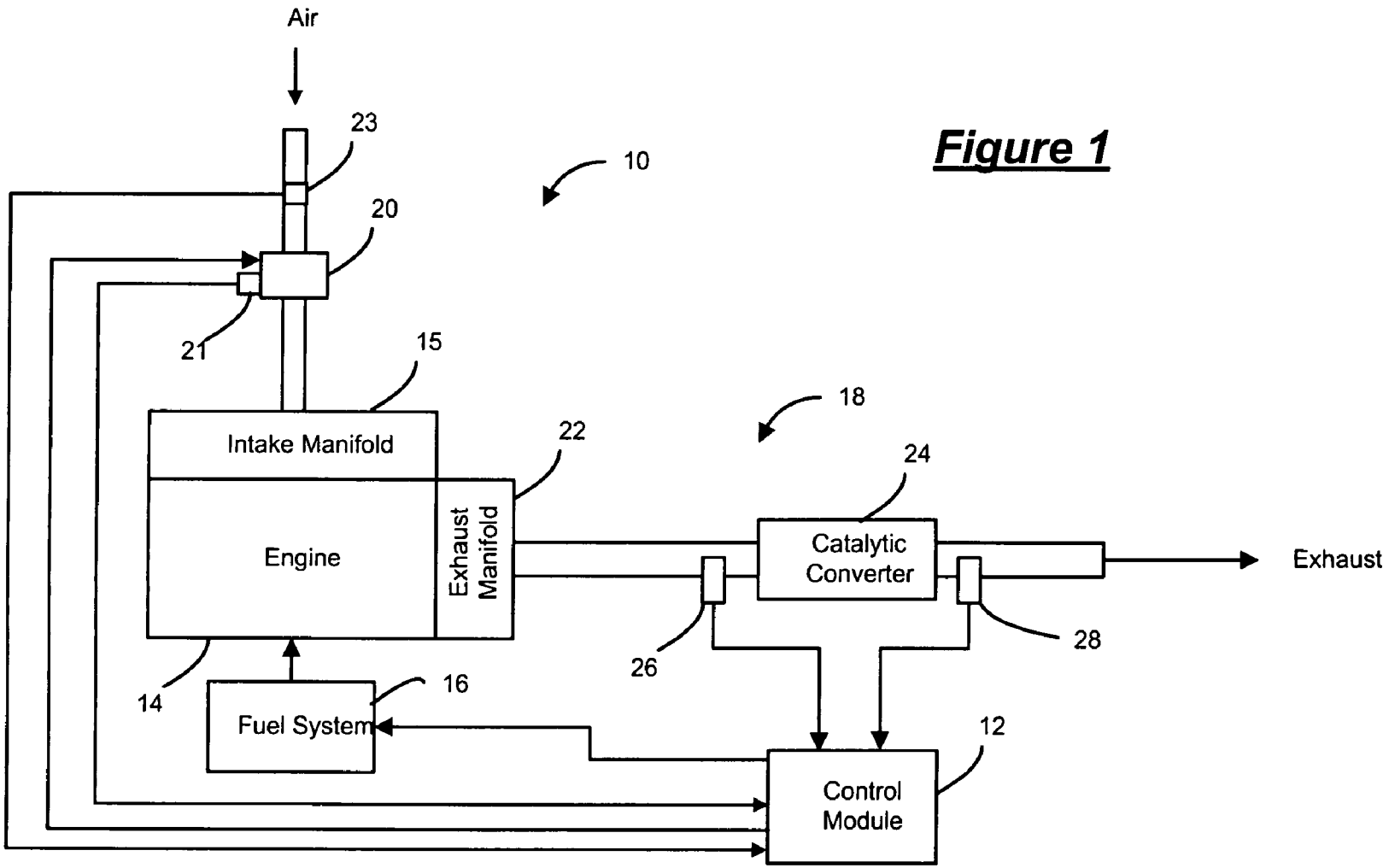
FIG. 1 is a schematic illustration of an exemplary engine system that is regulated based on the lean idle control of the present invention.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

With reference to FIG. 1, an exemplary vehicle 10 includes a control module 12, an engine 14, a fuel system 16 and an exhaust system 18. The control module 12 communicates with various sensors, actuators and valves. The engine 14 includes a throttle 20 that communicates with the control module 12. The throttle 20 regulates the amount of air drawn into the engine 14 during an intake stroke of the pistons (not shown). The engine 14 operates in a lean condition (i.e. reduced fuel) when the air to fuel ratio (AFR) is higher than a stoichiometric air to fuel ratio ($AFR_{STOICH}$). The engine 14 operates in a rich condition when AFR is less than $AFR_{STOICH}$. Stoichiometry is defined as an ideal AFR (e.g., 14.7-to-1 for gasoline). Internal combustion within the engine 14 produces exhaust gas that flows from the engine 14 to the exhaust system 18, which treats the exhaust gas and releases the treated exhaust gas to the atmosphere.

The control module 12 receives a throttle position signal from a throttle position sensor (TPS) 21 and a mass air flow (MAF) signal from a MAF sensor 23. The throttle position signal and the MAF signal are used to determine the air flow into the engine 14. The air flow data is used to calculate the corresponding fuel to be delivered to the engine 14 by the fuel system 16.

The exhaust system 18 includes an exhaust manifold 22, a catalytic converter 24, an inlet oxygen sensor 26 located upstream from the catalytic converter 24, and an outlet oxygen sensor 28 located downstream from the catalytic converter 24. It is anticipated that the sensors 26,28 can be of a type known in the art including, but not limited to, switching sensors and wide-range air-fuel (WRAF) sensors. The catalytic converter 24 treats the engine-out emissions by increasing the rate of oxidization of hydrocarbons (HC) and carbon monoxide (CO), and the rate of reduction of nitrogen oxides ($NO_x$), to decrease tail-pipe emissions.

To enable oxidization, the catalytic converter 24 requires air or oxygen and the catalytic converter 24 can release stored oxygen as needed. In a reduction reaction, oxygen is generated from $NO_x$ and the catalytic converter 24 can store the extra oxygen as appropriate. The oxygen storage capacity (OSC) of the catalytic converter 24 is indicative of the catalytic converter's efficiency in oxidizing the HC and CO, and reducing NOx. The inlet oxygen sensor 26 communicates with the control module 12 and is responsive to the oxygen content of the exhaust stream entering the catalytic converter 24. The outlet oxygen sensor 28 communicates with the control module 12 and is responsive to the oxygen content of the exhaust stream exiting the catalytic converter 24.

The inlet oxygen sensor 26 and the outlet oxygen sensor 28 respectively generate an inlet sensor signal (ISS) and an outlet sensor signal (OSS). The ISS and OSS are voltage signals that vary based on the oxygen content of the exhaust. More specifically, as the oxygen content of the exhaust increases (e.g., AFR goes high or fuel goes lean), the voltage signal decreases. As the oxygen content of the exhaust decreases (e.g., AFR goes low or fuel goes rich), the voltage signal increases. The control module 12 receives the ISS and OSS and correlates the sensor signal voltage to the oxygen content level of the exhaust.

The post-lean idle control of the present invention monitors engine operating parameters during a lean idle period ($t_{IDLE}$). The engine is operated lean during idle to improve fuel consumption because less fuel is consumed when operating lean. The engine is operated rich for a calculated period ($t_{RICH}$) after lean idle operation. More specifically, the post-lean idle control of the present invention determines an excess mass fuel rate ($\dot{m}_{FUELEXC}$) based on the engine operating conditions during the lean idle period ($t_{IDLE}$). After the lean idle operation ends, the engine is operated rich to deliver $\dot{m}_{FUELEXC}$ for $t_{RICH}$ In this manner, the excess oxygen stored in the catalytic converter is efficiently reduced to the desired level after an extended period of lean engine idle.

The post-lean idle control calculates an excess mass air flow ($MAF_{EXC}$) based on the actual air to fuel ratio ($AFR_{LEAN}$), the stoichiometric air to fuel ratio ($AFR_{STOICH}$) and the lean fuel rate ($\dot{m}_{FUELLEAN}$) during $T_{IDLE}$ according to the following equation:

$$MAF_{EXC}=(AFR_{LEAN}-AFR_{STOICH})\dot{m}_{FUELLEAN}$$

The mass of oxygen stored in the catalytic converter ($m_{O2STRD}$) during $t_{IDLE}$ is determined based on the following relationship:

$$m_{O2STRD}=\mathrm{MIN}[((\%\ O2_{AIR})(MAF_{EXC})(t_{IDLE}),\ m_{O2TARGET})]$$

where % $O2_{AIR}$ is the percentage of oxygen in air by weight (i.e., 23.2%) and $m_{O2TARGET}$ is the target mass of stored oxygen. $m_{O2TARGET}$ is calculated based on the following equation:

$$m_{O2TARGET}=(f_{O2})(m_{O2CAP})$$

where $f_{O2}$ is an oxygen storage factor and is the amount of oxygen reserve desired in the catalytic converter (e.g., equal to a nominal value of 0.5). It is anticipated that $f_{O2}$ can vary (i.e., is reduced over time) based on a calculated OSC to account for aging. $m_{O2CAP}$ is the oxygen mass storage capacity of a new catalytic converter and is a fixed catalytic converter design parameter.

A stoichiometric oxygen to fuel ratio ($OFR_{STOICH}$) is calculated based on the following equation:

$$OFR_{STOICH}=(AFR_{STOICH})(\%\ O2_{AIR})$$

The rich fuel mass required to reduce the stored oxygen to the desired level during $t_{RICH}$ is calculated according to the following stoichiometric relationship:

$$m_{FUELRICH}=\frac{m_{O2STRD}}{OFR_{STOICH}}$$

$t_{RICH}$ is calculated based on the following equation:

$$t_{RICH}=\frac{m_{FUELRICH}}{\dot{m}_{FUELEXC}}$$

where $\dot{m}_{FUELEXC}$ is calculated according to the following relationship:

$$\dot{m}_{FUELEXC}=\frac{MAF_{EXC}}{(AFR_{STOICH}-AFR_{RICH})}$$

where $AFR_{RICH}$ is the air to fuel ratio during $t_{RICH}$ and is a calibrated value (e.g., approximately 13.1). It is anticipated that $AFR_{RICH}$ can vary based on a temperature of the catalytic converter ($T_{CAT}$) (e.g., determine $AFR_{RICH}$ from a look-up table based on $T_{CAT}$). $MAF_{EXC}$ is the mass air flow during $t_{IDLE}$, which is based on the signal from the MAF sensor.

Figure 2:
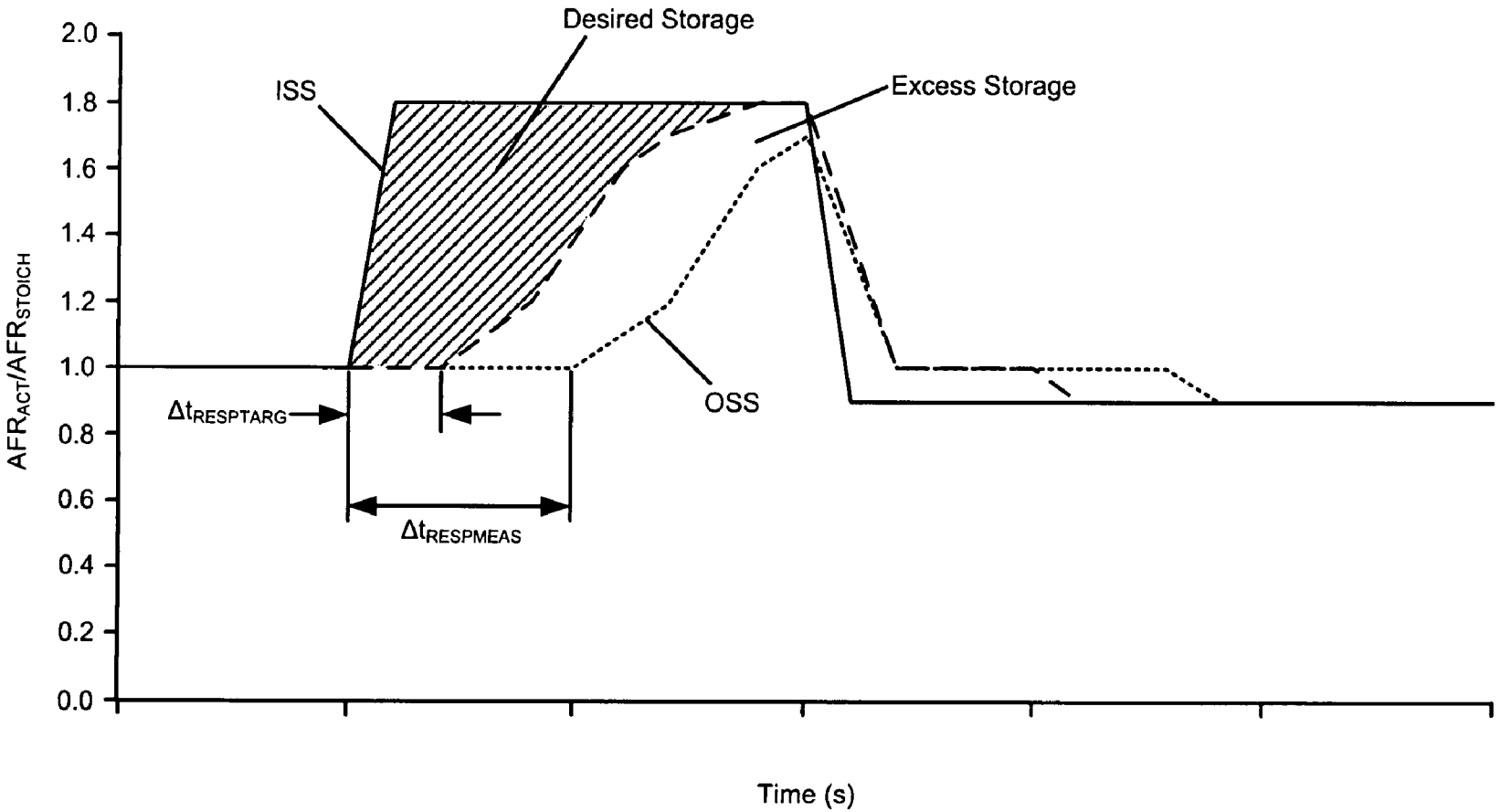
FIG. 2 is a graph illustrating exemplary pre-catalyst and post catalyst sensor signals for rich to lean and lean to rich transitions.

Referring now to FIG. 2, the post-lean idle control of the present invention can correct $t_{RICH}$ based on the ISS and the OSS. More specifically, an error factor ($f_{ERROR}$) is calculated according to the following equation:

$$f_{ERROR}=\frac{t_{RESPTARG}}{t_{RESPMEAS}}$$

where $t_{RESPTARG}$ is the target or desired response time of the OSS (i.e., lag time to go lean/rich after ISS) and $t_{RESPMEAS}$ is the measured or actual response time of the OSS. $t_{RESPTARG}$ is calculated based on the following relationship:

$$t_{RESPTARG}=\frac{m_{O2TARGET}}{(MAF_{EXC})(\%\ O2_{AIR})}$$

A corrected $t_{RICH}$ ($t_{RICHCORR}$) is calculated as the product of $t_{RICH}$ and $f_{ERROR}$. In this manner, $f_{ERROR}$ functions as an adaptively learned gain factor. $f_{ERROR}$ will be equal to one when there is sufficient oxygen storage, greater than one when there is insufficient oxygen storage and less than one if there is excess oxygen storage. The post-lean idle control operates the engine to provide $\dot{m}_{FUELEXC}$ for $t_{RICHCORR}$ to reduce the stored oxygen to the desired level.

Figure 3:
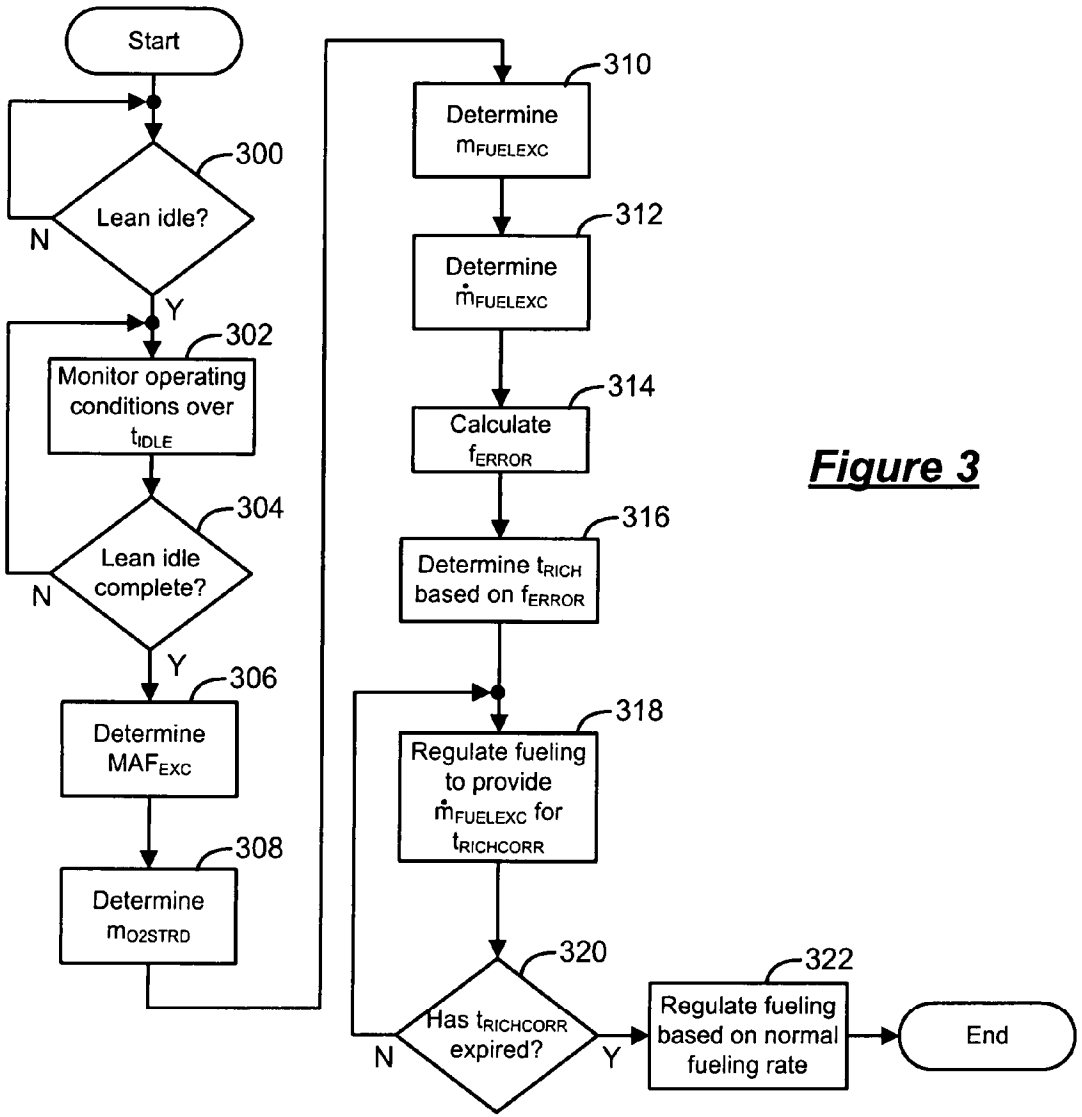
FIG. 3 is a flowchart illustrating exemplary steps executed by the lean idle control of the present invention.

Referring now to FIG. 3, exemplary steps executed by the post-lean idle control of the present invention will be described in detail. In step 300, control determines whether the engine is operating in lean idle. If the engine is not operating in lean idle, control loops back. If the engine is operating in lean idle, control monitors the engine operating conditions over $t_{IDLE}$ in step 302. In step 304, control determines whether lean idle operation is complete. If lean idle operation is not complete, control loops back to step 302. If lean idle operation is complete, control continues in step 306.

In step 306, control determines $MAF_{EXC}$ based on $AFR_{ACT}$, $AFR_{STOICH}$ and $\dot{m}_{FUELLEAN}$ during $t_{IDLE}$. Control determines $M_{O2STRD}$ in step 308 and $m_{FUELRICH}$ in step 310. In step 312, control determines $\dot{m}_{FUELEXC}$ In step 316, control corrects $t_{RICH}$ based on $f_{ERROR}$. Control regulates fueling to the engine to provide $\dot{m}_{FUELEXC}$ for $t_{RICHCORR}$ in step 318. In step 320, control determines whether $t_{RICHCORR}$ has expired. If $t_{RICHCORR}$ has not expired, control loops back to step 318. If $t_{RICHCORR}$ has expired, control regulates fueling based on a normal fueling rate in step 322 and control ends. The normal fueling rate can include, but is not limited to, a fueling rate that provides $AFR_{STOICH}$.

Figure 4:
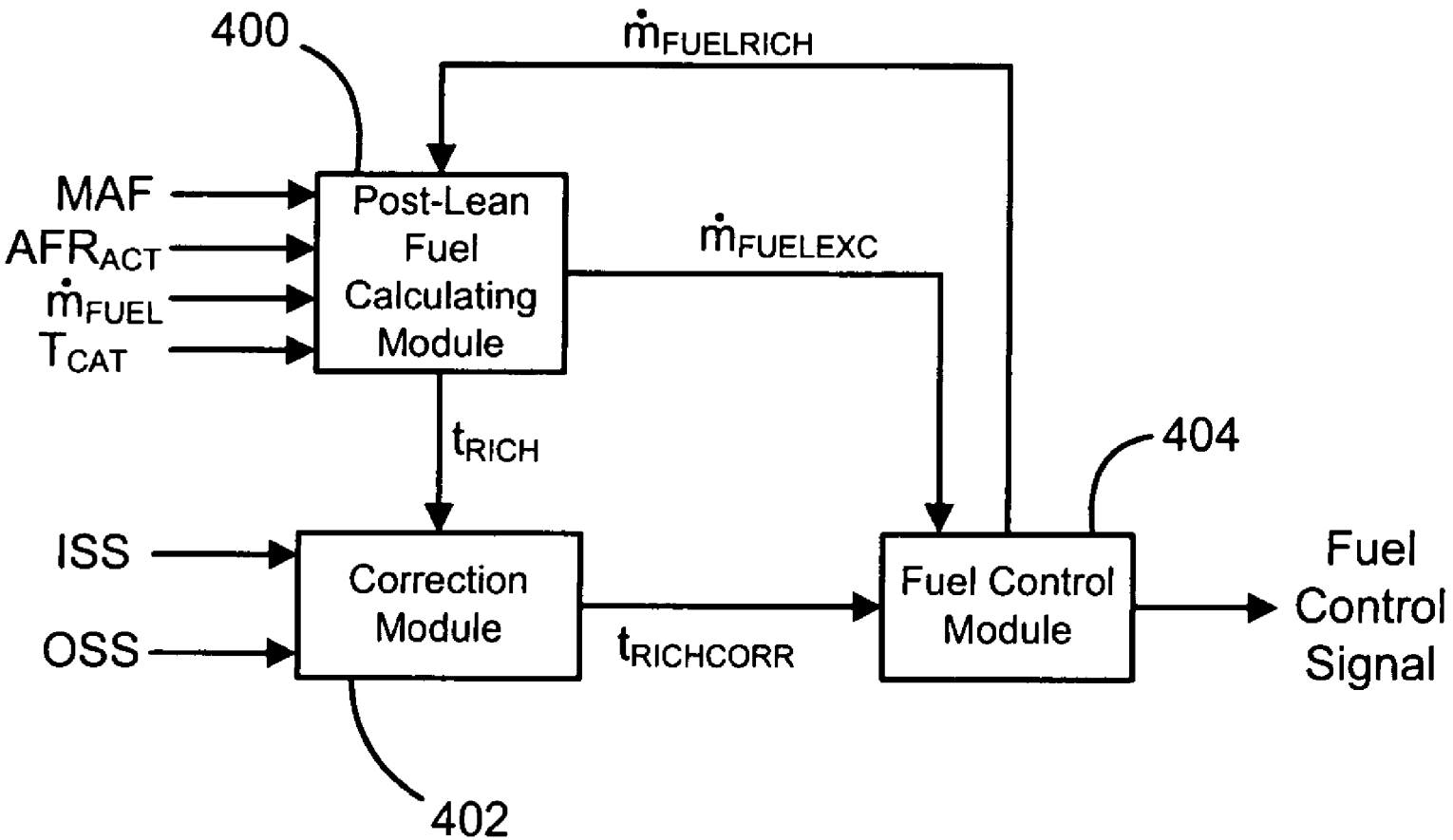
FIG. 4 is a schematic illustration of exemplary modules that execute the lean idle control of the present invention.

Referring now to FIG. 4, exemplary modules that execute the post-lean idle control of the present invention will be described in detail. The exemplary modules include a post-lean fuel calculating module 400, a correction module 402 and a fuel control module 404. The post-lean fuel calculating module 400 determines $\dot{m}_{FUELEXC}$ and $t_{RICH}$ based on MAF, $AFR_{ACT}$ and $\dot{m}_{FUEL}$. The correction module 402 determines $t_{RICHCORR}$ based on $t_{RICH}$. The fuel control module 404 generates a fuel control signal to regulate engine operation based on $\dot{m}_{FUELEXC}$ and $t_{RICHCORR}$.

The post-lean idle control of the present invention precisely meters the amount (i.e., $\dot{m}_{FUELEXC}$) and the duration (i.e., $t_{RICHCORR}$) of the rich fueling event after lean idle. In this manner, the conversion efficiency of the catalytic converter is maximized for optimal emissions and the fuel consumption penalty for depleting the stored oxygen is minimized to provide optimal fuel economy.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An engine control system that regulates fuel to an engine after lean idle operation, comprising:

a first module that determines a rich mass fuel rate based on a lean operation mass air flow and a stoichiometric air to fuel ratio (AFR) and that calculates a time rich based on said rich mass fuel rate, a mass of oxygen stored in a catalytic converter stored during said lean idle operation, and an oxygen to fuel ratio (OFR); and a second module that regulates fuel to said engine during a rich operation period after said lean idle operation to provide said rich mass fuel rate for said time rich, wherein said first module determines said OFR based on said stoichiometric AFR, calculates a product of a % oxygen content of air by mass, said lean operation mass air flow and a lean time, and determines said mass of oxygen stored as a minimum of said product and a target mass of oxygen stored.

2. The engine control system of claim 1 wherein said target mass of oxygen stored is based on a storage factor and a storage capacity of said catalytic converter.

3. The engine control system of claim 1 further comprising a third module that corrects said time rich based on an inlet sensor signal and an outlet sensor signal of said catalytic converter.

4. The engine control system of claim 3 wherein said third module measures an actual response time between said inlet sensor signal and said outlet sensor signal and calculates a correction factor based on said actual response time and a target response time.

5. A method of regulating fuel to an engine after lean idle operation to reduce an oxygen content of a catalytic converter, comprising:

determining a rich mass fuel rate based on a lean operation mass air flow and a stoichiometric air to fuel ratio (AFR);

determining an oxygen to fuel ratio (OFR) based on said stoichiometric AFR;

calculating a product of a % oxygen content of air by mass, said lean operation mass air flow, and a lean time;

determining a mass of oxygen stored in a catalytic converter during said lean idle operation as a minimum of said product and a target mass of oxygen stored;

calculating a time rich based on said rich mass fuel rate, said mass of oxygen stored, and said OFR; and regulating fuel to said engine during a rich operation period after said lean idle operation to provide said rich mass fuel rate for said time rich.

6. The method of claim 5 wherein said target mass of oxygen stored is based on a storage factor and a storage capacity of said catalytic converter.

7. The method of claim 5 further comprising correcting said time rich based on an inlet sensor signal and an outlet sensor signal of said catalytic converter.

8. The method of claim 7 further comprising:

measuring an actual response time between said inlet sensor signal and said outlet sensor signal; and calculating a correction factor based on said actual response time and a target response time.

9. A method of regulating fuel to an engine to reduce an oxygen content of a catalytic converter, comprising:

operating said engine lean during an idle period;

monitoring a lean mass air flow during said idle period;

determining a rich mass fuel rate based on said lean mass air flow and a stoichiometric air to fuel ratio (AFR) upon expiration of said idle period;

determining an oxygen to fuel ratio (OFR) based on said stoichiometric AFR;

calculating a product of a % oxygen content of air by mass, said lean mass air flow and a lean time;

determining a mass of oxygen stored in a catalytic converter during said lean idle period as a minimum of said product and a target mass of oxygen stored;

calculating a time rich based on said rich mass fuel rate, said mass of oxygen stored, and said OFR; and regulating fuel to said engine during a rich operation period after said lean idle operation to provide said rich mass fuel rate for said time rich.

10. The method of claim 9 wherein said target mass of oxygen stored is based on a storage factor and a storage capacity of said catalytic converter.

11. The method of claim 9 further comprising correcting said time rich based on an inlet sensor signal and an outlet sensor signal of said catalytic converter.

12. The method of claim 11 further comprising:

measuring an actual response time between said inlet sensor signal and said outlet sensor signal; and calculating a correction factor based on said actual response time and a target response time.

* * * * *